US007546860B1

(12) United States Patent
Mehdizadeh

(10) Patent No.: US 7,546,860 B1
(45) Date of Patent: Jun. 16, 2009

(54) BUSINESS CARD HOLDER ATTACHED TO THE OUTSIDE OF A WALLET

(76) Inventor: P Vincent Mehdizadeh, 9301 Wilshire Blvd., No. 508, Beverly Hills, CA (US) 90210

( * ) Notice: Subject to any disclaimer, the term of this patent is extended or adjusted under 35 U.S.C. 154(b) by 186 days.

(21) Appl. No.: 11/218,842

(22) Filed: Sep. 2, 2005

(51) Int. Cl.
*A45C 1/06* (2006.01)

(52) U.S. Cl. ..... 150/138; 150/132; 150/147; 206/39

(58) Field of Classification Search ..... 150/131–150; 206/39; D3/247–249
See application file for complete search history.

(56) References Cited

U.S. PATENT DOCUMENTS

| | | | | | |
|---|---|---|---|---|---|
| 22,417 | A | | 12/1858 | Fessel | |
| 46,173 | A | | 1/1865 | Yates | |
| 154,714 | A | | 9/1874 | Reed | |
| 216,825 | A | | 6/1879 | Bobo | |
| 286,650 | A | | 10/1883 | Talcott | |
| 1,686,483 | A | * | 10/1928 | Ballou et al. | 150/132 |
| 1,787,054 | A | * | 12/1930 | Scheuer | 150/145 |
| 2,203,830 | A | * | 6/1940 | Leue | 206/38.1 |
| 2,417,322 | A | * | 3/1947 | Plotzky | 150/136 |
| D161,264 | S | * | 12/1950 | Jeffrey | D3/250 |
| 3,199,562 | A | * | 8/1965 | Seitz | 150/139 |
| 3,446,260 | A | | 5/1969 | Osher | |
| 4,016,664 | A | * | 4/1977 | Kaufmann | 40/642.02 |
| 4,037,634 | A | * | 7/1977 | Ricciardi | 150/133 |
| 4,126,168 | A | | 11/1978 | Ganz | |
| 4,570,688 | A | * | 2/1986 | Williams | 150/134 |
| 4,705,086 | A | * | 11/1987 | O'Neill | 150/134 |
| 4,824,703 | A | | 4/1989 | Bernard | |
| 5,004,144 | A | * | 4/1991 | Selga | 229/87.19 |
| 5,222,764 | A | * | 6/1993 | Dyer | 281/45 |
| 5,452,793 | A | | 9/1995 | DiMeo | |
| 5,544,745 | A | * | 8/1996 | Famorca | 206/320 |
| D380,009 | S | * | 6/1997 | Pycher | D19/86 |
| 5,653,276 | A | | 8/1997 | Niernberger | |
| 5,778,954 | A | | 7/1998 | Sullivan | |
| D404,566 | S | | 1/1999 | Archer | |
| D418,293 | S | * | 1/2000 | Palmer | D3/248 |
| D433,804 | S | | 11/2000 | Kojoori | |
| D434,899 | S | * | 12/2000 | Kojoori | D3/249 |
| D435,339 | S | * | 12/2000 | Cleveland | D3/249 |
| D435,965 | S | | 1/2001 | Kim | |
| D443,414 | S | * | 6/2001 | Schimmel | D3/250 |
| 6,240,989 | B1 | | 6/2001 | Masoud | |
| 6,435,236 | B2 | | 8/2002 | Gribovsky | |

(Continued)

FOREIGN PATENT DOCUMENTS

| | | | |
|---|---|---|---|
| GB | 2393640 | A | 4/2004 |

(Continued)

*Primary Examiner*—Sue A Weaver
(74) *Attorney, Agent, or Firm*—Thomas I. Rozsa

(57) ABSTRACT

The present invention is a man's wallet that can fit into a pocket in a man's trousers or into the inside pocket of a suit jacket or sport coat and which has incorporated into its exterior surface a business card holder which is either permanently attached or removably attached to an exterior surface of the wallet. With a business card holder incorporated into the wallet, a person will be able to carry business cards when he takes his wallet and will not forget to take business cards as he might do if the business card holder was a separate container.

12 Claims, 12 Drawing Sheets

U.S. PATENT DOCUMENTS

| | | | | |
|---|---|---|---|---|
| D471,008 | S * | 3/2003 | Dubone | D3/247 |
| 6,601,622 | B1 * | 8/2003 | Young | 150/138 |
| D508,532 | S * | 8/2005 | Hertz | D19/90 |
| D522,239 | S * | 6/2006 | Herring | D3/248 |
| D526,480 | S * | 8/2006 | Nuttall | D3/247 |
| 2001/0027834 | A1 * | 10/2001 | Southwick | 150/108 |
| 2003/0102063 | A1 * | 6/2003 | Brody | 150/104 |
| 2005/0194273 | A1 * | 9/2005 | Frankeny | 206/311 |

FOREIGN PATENT DOCUMENTS

| | | |
|---|---|---|
| JP | 200050935 | 2/2000 |

* cited by examiner

BUSINESS CARD HOLDER ATTACHED TO THE OUTSIDE OF A WALLET

BACKGROUND OF THE INVENTION

1. Field of the Invention

The present invention relates to the field of men's wallets which can fit into a pocket of a man's trousers or fit into the inside pocket of a jacket and which has means to retain business cards.

2. Description of the Prior Art

The following eighteen (18) patents and published patent applications are relevant to the field of the present invention.

1. U.S. Pat. No. 286,650 issued to Talcott on Oct. 16, 1883 for "Combination Pocket Case" (hereafter the "Talcott patent");

2. U.S. Pat. No. 22,417 issued to Scheuer on May 9, 1893 for "Pocket Book" (hereafter the "Scheuer patent");

3. U.S. Pat. No. 3,446,260 issued to Osher on May 27, 1969 for "Card Holder For Wallets" (hereafter the "Osher patent");

4. U.S. Pat. No. 4,126,168 issued to Ganz on Nov. 21, 1978 for "Multi-Purpose Pocket-Size Carrying Case" (hereafter the "Ganz patent");

5. U.S. Pat. No. 4,824,703 issued to Bernard on Apr. 25, 1989 for "Leather Of Fabric Article Incorporating An Attached Trimming" (hereafter the "Bernard patent");

6. U.S. Pat. No. 5,452,793 issued to DiMeo on Sep. 26, 1995 "Business Card Case" (hereafter the "DiMeo patent");

7. U.S. Pat. No. 5,653,276 issued to Niemberger on Aug. 5, 1997 for "Combination Wallet And Billfold" (hereafter the "Niemberger patent");

8. U.S. Pat. No. 5,778,954 issued to Sullivan on Jul. 14, 1998 for "Wallet/Pocket Knife Holder" (hereafter the "Sullivan patent");

9. U.S. Pat. No. Des. 404,566 issued to Archer on Jan. 26, 1999 for "Business Card Holder And Dispenser" (hereafter the "Archer patent");

10. U.S. Pat. No. Des. 433,804 issued to Kojoori on Nov. 21, 2000 for "Bifold Front Pocket Wallet" (hereafter the "Kojoori patent");

11. U.S. Pat. No. 6,240,989 B1 issued to Masoud on Jun. 5, 2001 for "Business Card Holder And Dispenser" (hereafter the "Masoud patent");

12. U.S. Pat. No. D435,965 S issued to Kim on Jan. 9, 2001 for "Wallet With Key Holding Cavity" (hereafter the "Kim patent");

13. U.S. Pat. No. 6,435,236 B2 issued to Gribovsky on Aug. 20, 2002 for "Money Clip" (hereafter the "Gribovsky patent");

14. United States Patent Application Publication No. US 2004/0154714 A1 to Gray on Aug. 12, 2004 for "Combination Wallet And Tool Holder" (hereafter the "Gray Published patent application");

15. United States Patent Application Publication No. US 2004/0216825 A1 to Radochonski on Nov. 4, 2004 for "Combination. Wallet, Timepiece And Money Clip" (hereafter the "Radochonski Published patent application");

16. United States Patent Application Publication No. US 2005/0046173 A1 to Hall on Mar. 3, 2005 for "Body With Outer Detachable Pouch" (hereafter the "Hall Published patent application");

17. UK Patent Application No. GB 2,393,640 A to Huang on Jul. 4, 2004 for "Wallet Or Cover And Holder For Electronic Handheld Apparatus" (hereafter the "Huang patent");

18. Japanese Patent Application 200050935 for "Card Case or the Like with Clip and the Clip" by inventor Uno Keiichi (hereafter the "Keiichi patent")/

The Talcott patent discloses a combination pocket case that has various pockets to carry different objects such as matches, railway tickets etc. Area A where enables tickets to be placed on the outside of the combination pocket case.

The Scheuer patent is a design patent which discloses a pocket book which includes a box like Figure A arranged on the outer side of the pocket book B. The inner side C and bottom D of the box-like Figure A are irregular in contour to give a flexible and loose effect in sharp contrast to the rigid face of the side of the pocket book B. The device is used with a lady's pocket book.

The Osher patent which issued in 1969 discloses a card holder for wallets which includes the clear plastic material sections which can be used to hold credit cards etc. The transparent flat sections 16 coact with the support portions 23 to define or provide pockets or pouches 16 for receiving photographs or cards such as the cards 17 and 18.

The Ganz patent discloses a carrying case which has an expandable compartment 17 attached to the exterior side of the center compartment 12 and this compartment is intended for storing miscellaneous items. The compartment 17 comprises a piece of material attached by stitching to the face of the section 12 and pleats 18, 19 are provided to permit expansion of the compartment to accommodate the desired articles. A cover flap 20 is provided with a snap fastener (not visible) for enabling ready opening and closing of the compartment.

The Bernard patent discloses a billfold showing flaps 1 and 2 of the billfold of FIG. 2 which comprise an outer wall 7 and an inner wall 8 referred to as "lining" joined together. The outer wall 7 and the lining 8 are joined by stitching along their edges. Before stitching the outer wall 7 to the lining 8, and for the purposes of fitting the corner region 3 of the flap 1 with a metal corner, a metal plate 9 is stuck in this region against the face of the lining 8 situated facing the wall 7.

The DiMeo patent is a business card case and is basically a stand-alone business card case. The innovation of the DiMeo patent is that it includes a shallow front lip for retaining the bottom edge of a stack of business cards and a hinge-mounted plate which is operative for lifting the top edge of a stack of business cards upwardly when the cover is opened so that the top card may be easily removed.

The Niemberger patent discloses a combination wallet and billfold which incorporates a money clip 32 into the face of the wallet and a strap 70 so that the strap can wrap around the money clip to further secure the bills in the money clip.

The Sullivan patent discloses a combination of a wallet and a pocket knife holder where the wallet has a plurality of sections which overlie each other when the wallet is folded. One of the sections has a pocket which removably frictionally receives a pocket knife.

The Archer patent is a design patent for a business card holder and dispenser which essentially is an ornamental designed business card holder where the business cards are held within the slot with the business card shown in the elevated position in dotted lines in FIG. 1.

The Kojoori patent is a design patent that discloses the concept of having a wallet with a billfold clip on the outside to hold paper currency as illustrated in the view of FIGS. 9 and 10. There is a spring hinge activated billfold clip as shown in FIGS. 9 and 10 which support currency against the outside of the wallet.

The Masoud patent discloses a business card holder and dispenser which claims as its unique feature the ability to hold a large number of business cards while the nature of the mechanism in the business card dispenser enables the business cards to be easily removed and further, the device itself is small enough to fit in the pocket.

The Kim patent is a design patent where the innovation is that the wallet has a key holding cavity formed into the outside of the wallet so it is easy to gain access to the key from the outside of the wallet.

The Gribovsky patent discloses a money clip which essentially folds like a wallet and has an outer pocket 36 stitched to the outside with an opening 42 which can carry money. There is also a spring clip member 24 which can hold bills within the money clip.

The Gray Published patent application discloses a combination wallet and tool holder which carries wallet contents including credit cards, identification cards, business cards and money adjacent to a tool preventing the overlapping of the tool and the wallet contents.

The Radochonski Published patent application discloses the inclusion of having a watch attached to one face of the exterior portion of the wallet and a money clip attached to the opposite face of the exterior portion of a wallet.

The Hall Published patent application discloses a three ring binder notebook which has a front cover which has a generally flat planar outer surface having a pouch to hold items such as pencils and pens.

The United Kingdom Patent to Huang discloses a wallet or cover and holder for an electronic handheld apparatus. It is a wallet to hold the handheld apparatus which as illustrated in the dashed lines can be held on one face of the wallet. The wallet also has interior slits for holding credit cards.

Finally, the Japanese Patent Application to Keiichi discloses a clip to enable attachment of a business card case or commuter ticket card case to a pocket of clothing so that it will not slip down into the pocket.

There is a significant need for a man's wallet that is designed to also retain a business card holder.

SUMMARY OF THE INVENTION

The present invention is a man's wallet that can fit into a pocket in a man's trousers or into the inside pocket of a suit jacket or sport coat and which has incorporated into its exterior surface a business card holder which is either permanently attached or removably attached to an exterior surface of the wallet. With a business card holder incorporated into the wallet, a person will be able to carry business cards when he takes his wallet and will not forget to take business cards as he might do if the business card holder was a separate container.

It has been discovered, according to the present invention, that if a business card holder made of material comparable to the material out of which a man's wallet is made is incorporated into and attached to an exterior surface of the wallet, then the combination wallet and business card holder can still fit into the pocket of a man's pants or into the inside pocket of the coat of a business suit or sports coat.

It has also been discovered, according to the present invention, that if the business card holder is removably attached to the side of a man's wallet, the business card holder can be separated from the wallet if desired and carried separately in a different pocket.

It has additionally been discovered, according to the present invention, that if a business card holder is attached to the side of a man's wallet, the person will not forget to take business cards with him since he will always take his wallet whereas in the common present day situation where the business card holder is a separate entity distinct and apart from the wallet, the person may forget to take his business cards with him or will have to search for where he put down his business card holder. With the present invention, this problem is eliminated.

It has further been discovered, according to the present invention, that if the business card holder contains internal reinforcements on its interior corners, this will facilitate keeping the business cards crisp and easily removable from the business card holder.

It has also been discovered, according to the present invention, that having a business card holder on the outside surface of the man's wallet will not interfere with the wallet's normal function of retaining money, a driver's license, credit cards, etc. within the wallet.

It is therefore an object of the present invention to incorporate onto a man's wallet a business card holder which is made of material comparable to the material out of which the man's wallet is made whereby the business card holder is attached to an exterior surface of the wallet, so that the combination wallet and business card holder can still fit into the pocket of a man's pants or into the inside pocket of the coat of a business suit or sports coat.

It is also an object of the present invention to provide a business card holder which is removably attached to the side of a man's wallet so that the business card holder can be separated from the wallet if desired and carried separately in a different pocket.

It is additionally an object of the present invention provide a business card holder which is attached to the side of a man's wallet so that the person will not forget to take business cards with him since he will always take his wallet whereas in the common present day situation where the business card holder is a separate entity distinct and apart from the wallet, the person may forget to take his business cards with him or will have to search for where he put down his business card holder. With the present invention, this problem is eliminated.

It is as further object of the present invention to provide a business card holder which contains internal reinforcements on its interior corners so that the business cards will be kept crisp and easily removable from the business card holder.

It is also an object of the present invention to provide a business card holder on the outside of a man's wallet so that it will not interfere with the wallet's normal function of retaining money, a driver's license, credit cards, etc. within the wallet.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

There are two variations of the present invention man's wallet with a business card holder attached; a first variation where the business card holder is removably attached to an exterior surface of the man's wallet and the second variation where the business card holder is permanently attached to an exterior surface of a man's wallet.

Figure 9:
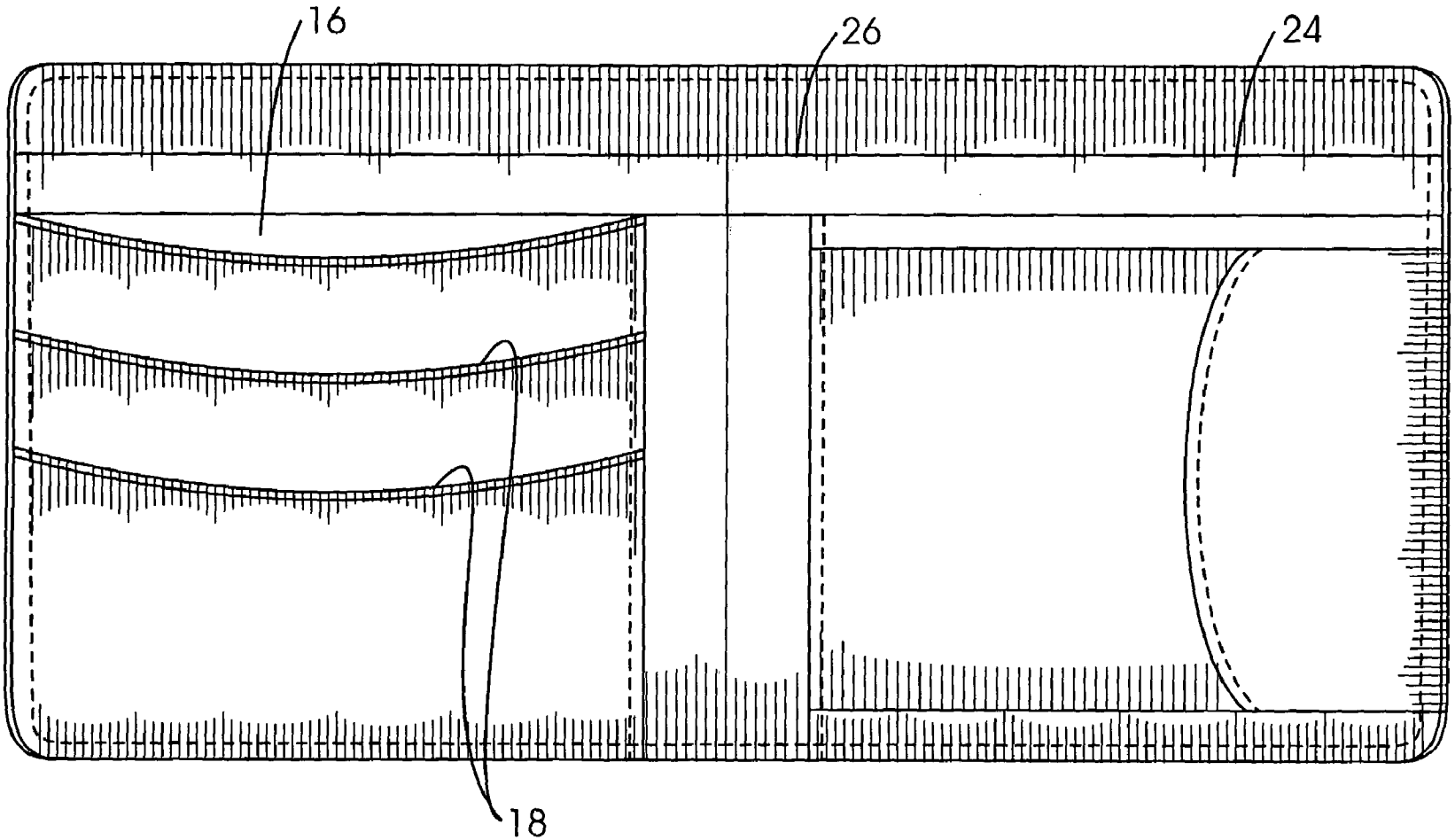
FIG. 9 is an internal elevational view of the present invention man's wallet showing the interior portion of the wallet.

The first variation of the present invention is illustrated in FIGS. 1 through 11. The man's wallet 10 is a conventional billfold having a first section 12 and a second section 20. The first section 12 has an exterior front surface 14 which does not have components thereon and an interior surface 16 which in one example as illustrated in FIG. 9 has a multiplicity of slots 18 for retaining credit cards, a driver's license, etc. The second section 20 has an exterior rear surface 22 and an interior surface 24 which in one example as illustrated in FIG. 9 has a closable compartment for containing change, keys, etc. There is also a conventional billfold slot 26 which extends the interior length of the wallet 10 for retaining paper currency.

The present invention is to incorporate a business card holder 30 onto the rear surface 22 of the wallet 10. In the first variation, the business card holder 30 has a rear section 32 with a rear surface 34 which incorporates a mating hook and/or loop fastener 36 known as Velcro onto the rear surface 34.

Figure 11:
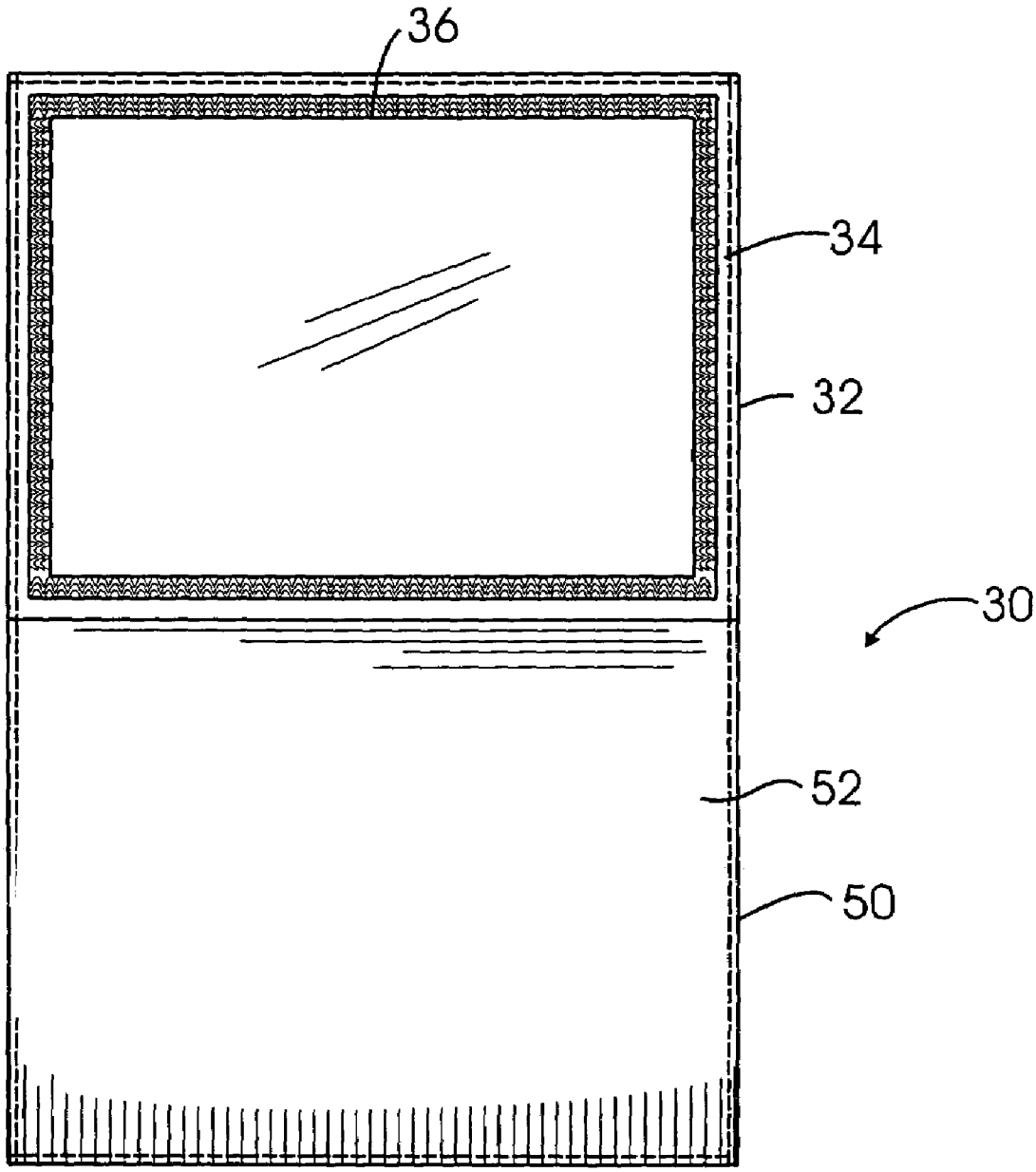
FIG. 11 is a rear elevational view of a business card holder illustrating removable attachment means hook and/or loop fasteners on one rear surface of the business card holder.
Figure 12:
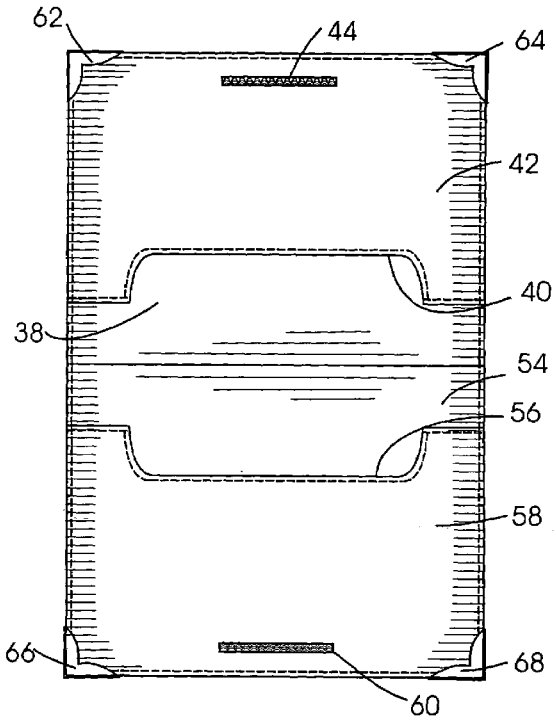
FIG. 12 is an open elevational view of the business card holder of the present invention illustrating the business card holder closing means and the reinforcement means on the corners of the business cards holder.
Figure 13:
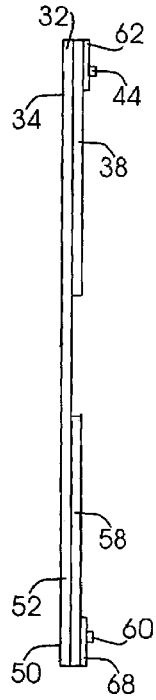
FIG. 13 is a side elevational view of the business card holder of the present invention.
Figure 14:
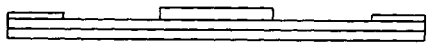
FIG. 14 is a top plan view of the business card holder of the present invention, a bottom plan view being identical.

Referring to FIGS. 11 and 12, the rear section 32 has an interior surface 38 which optionally may contain a compartment 40 having an interior section 42 wherein the compartment 40 to retain business cards is between the interior section 42 and the interior surface 38 of rear section 32. The interior section 42 also contain a mating hook and/or loop fastener 44

The business card holder also has a front section 50 with a front surface 52. Referring to FIG. 9, the front section 50 has an interior surface 54 which optionally may contain a compartment 56 having an interior section 58 wherein the compartment 56 to retain business cards is between the interior section 58 and the interior surface 54 of front section 50. The interior section 58 also contains a mating hook and/or loop fastener 60 which mates with mating hook and loop fastener 44 to close the business card holder 30.

The rear section 32 of the business card holder 30 contains a pair of reinforcements 62 and 64 at its opposite interior corners and the front section 50 also contains a pair of reinforcements 66 and 68 at its opposite interior corners. The reinforcements 62, 64, 66, and 68 serve to keep the business cards contained in the business card holder 30 crisp for ready removal.

Figure 1:
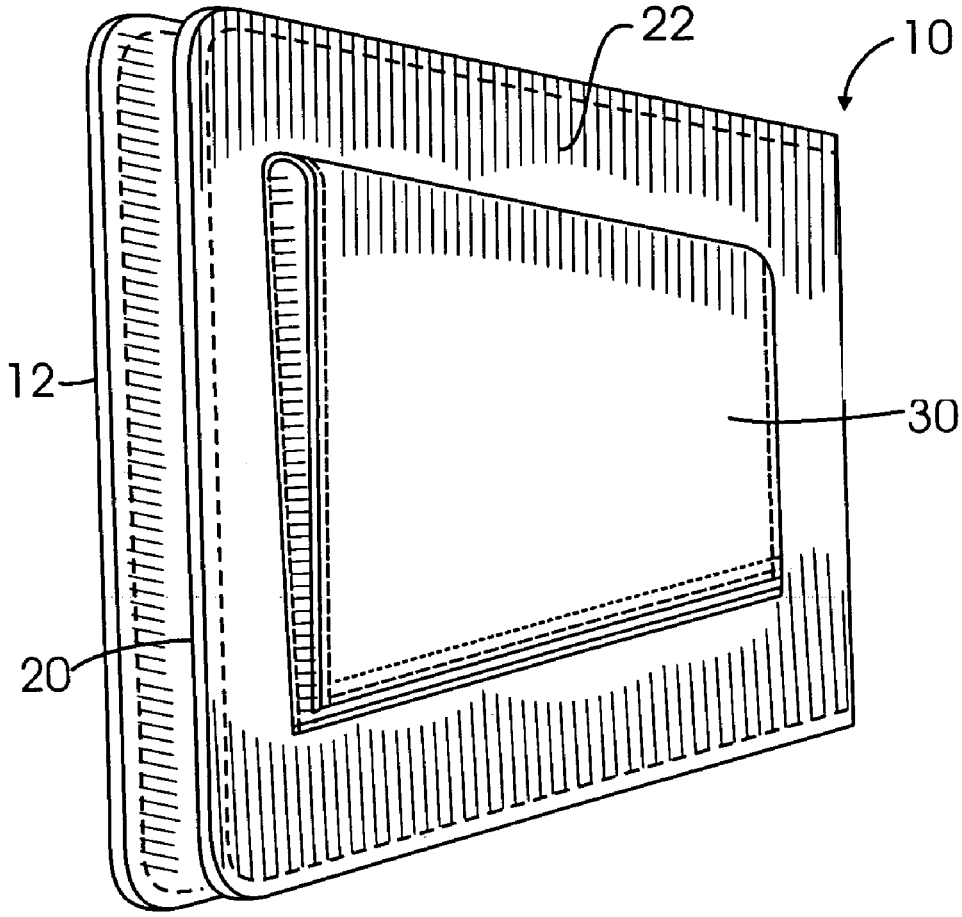
FIG. 1 is a perspective view of the present invention man's wallet with a business card holder removably attached to an exterior side of the wallet.
Figure 2:
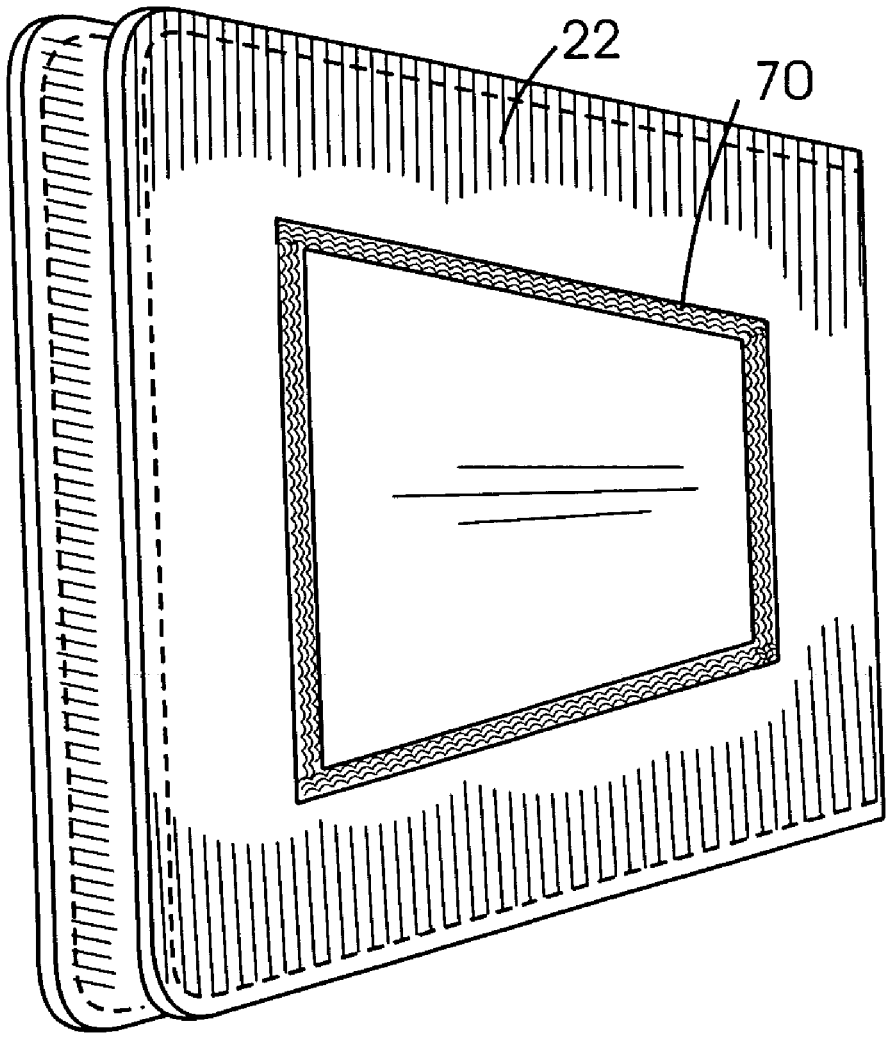
FIG. 2 is a perspective view of the present invention wherein the business card holder is removably attached to an exterior surface of a man's wallet and illustrating a mating hook and/or loop fastener on the exterior surface of the man's wallet.
Figure 3:
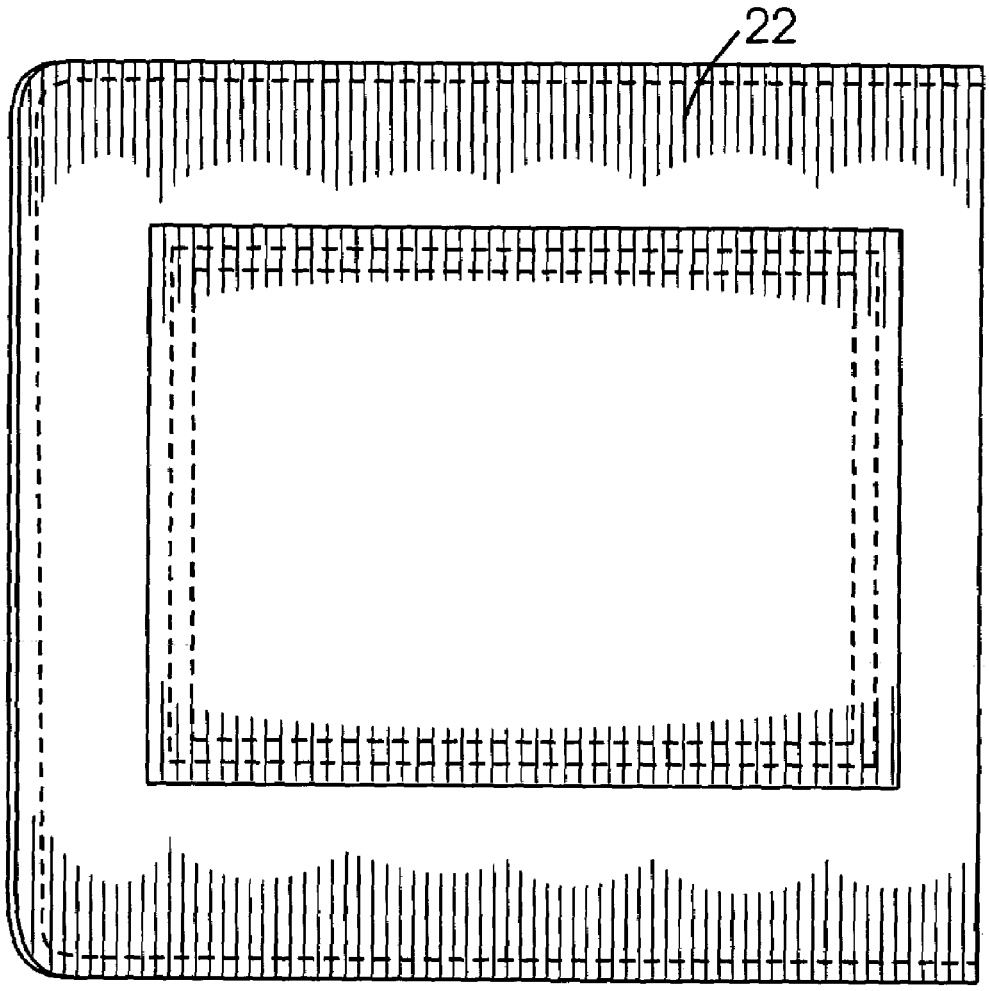
FIG. 3 is a rear elevational view of the present invention illustrating the business card holder removably attached to an exterior surface of a man's wallet, where the attachment means is shown in dashed lines.
Figure 4:
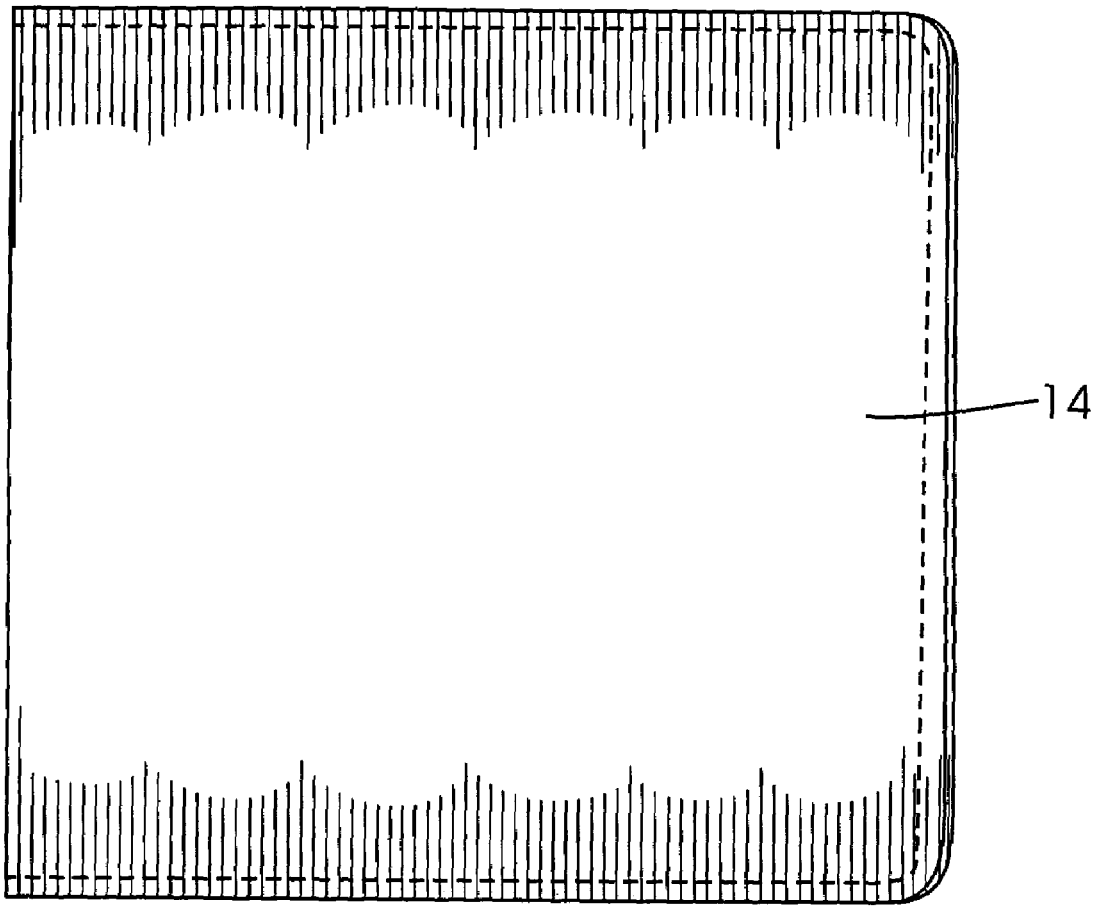
FIG. 4 is a front elevational view of a man's wallet where the business card holder is attached to the opposite exterior surface.
Figure 5:
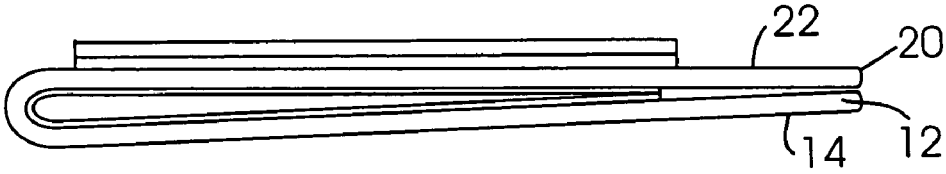
FIG. 5 is a bottom plan view of the present invention wallet with a business card holder attached to an exterior surface of the wallet.
Figure 6:
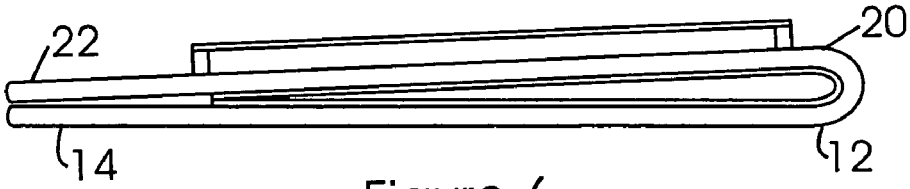
FIG. 6 is a top plan view of the present invention wallet with a business card holder attached to an exterior surface of the wallet.
Figure 7:
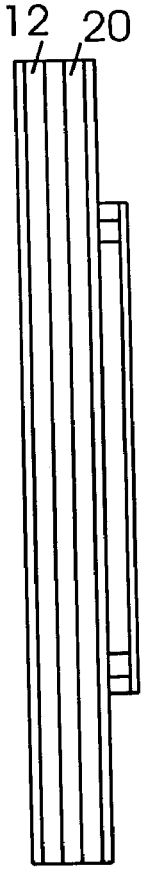
FIG. 7 is a side elevational view of the present invention wallet with a business card holder attached to an exterior surface of the wallet when viewed from the open side of the wallet.
Figure 8:
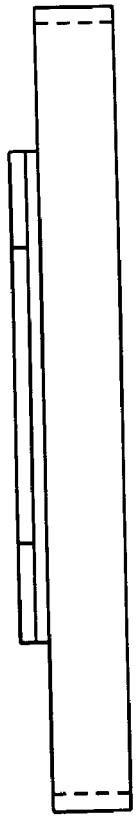
FIG. 8 is a side elevational view of the present invention wallet with a business card holder attached to an exterior surface of the wallet when viewed from the closed side of the wallet.
Figure 10:
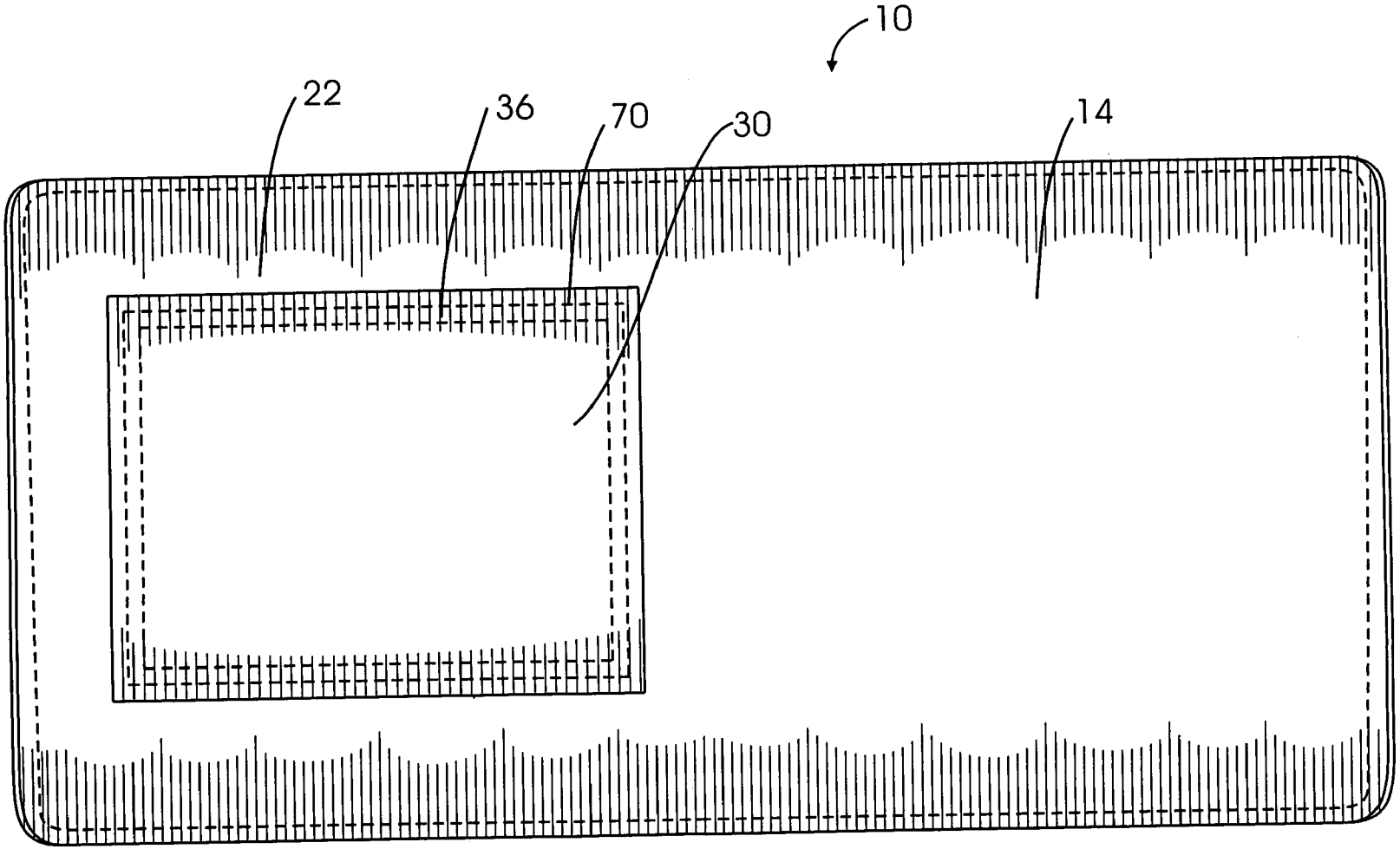
FIG. 10 is a rear elevational view of the present invention man's wallet showing the business card holder removably attached to an exterior surface with the removable attachment means illustrated in dashed lines.

Referring to FIG. 2, the exterior rear surface 22 of rear section 20 of wallet 10 further comprises a mating hook and/or loop fastener 70 which mates with hook and/or loop fastener 36 on the rear surface 34 of rear section 32 of business card holder 30. As illustrated in FIG. 10, when the mating hook and loop fasteners 70 and 36 are joined, the business card holder 30 is removably attached to the rear surface 34 of rear section 32 of wallet 10. As illustrated in FIG. 10 with the mating fasteners 44 and 60 of the business card holder 30 joined, the business card holder 30 fits smoothly against the rear surface 22 of the wallet 10 so that the wallet 10 with its contents including paper money, credit cards, driver's license, etc. and the business card holder 30 with business cards contained therein will fit into the pocket of a man's pants or into the inside pocket of the jacket of a suit or sports coat.

Since the business card holder 30 is retained by hook and loop fasteners, the business card holder 30 can be made of material which is the same material out of which the wallet is made or of different material. The wallet material is usually leather but can also be made of a synthetic material. Similarly, the business card holder can be made of leather or of a synthetic material.

Figure 15:
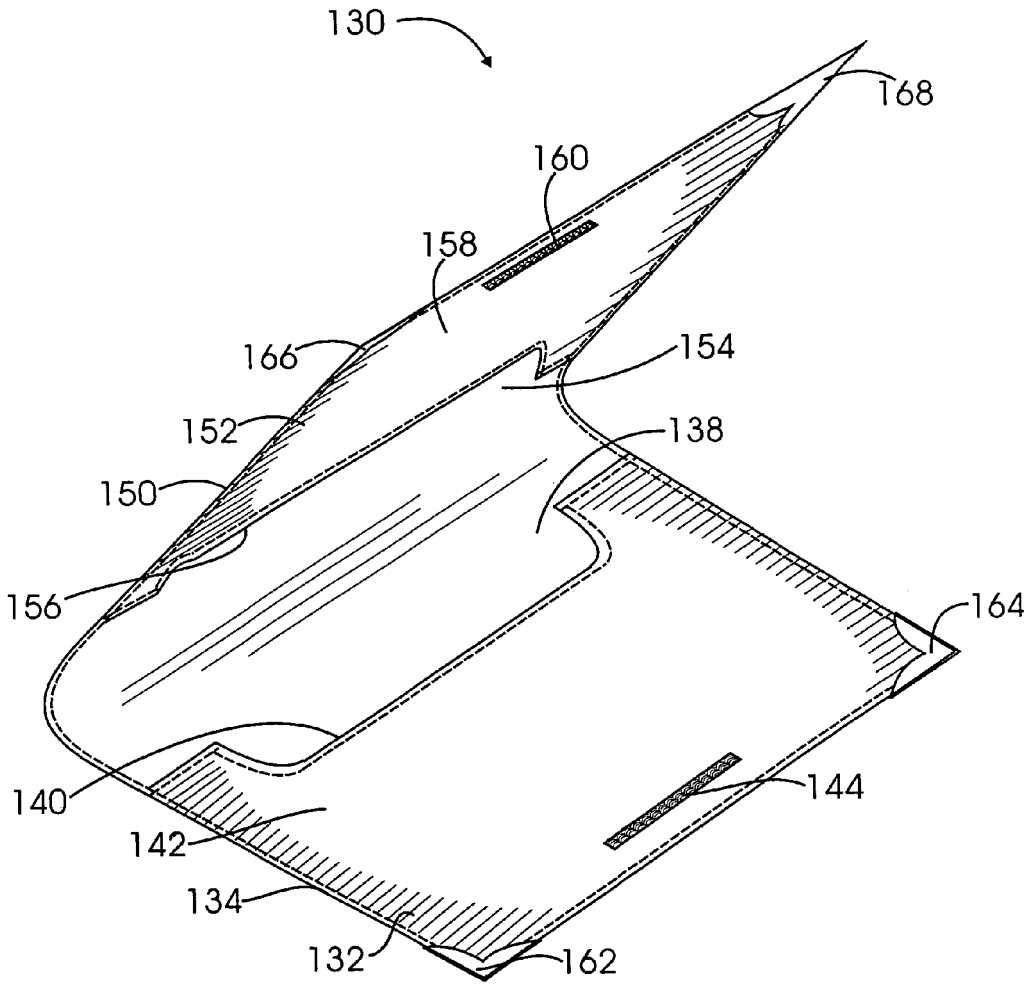
FIG. 15 is an open front perspective view of the business card holder of the present invention illustrating the business card holder closing means and the reinforcement means on the corners of the business cards holder.
Figure 16:
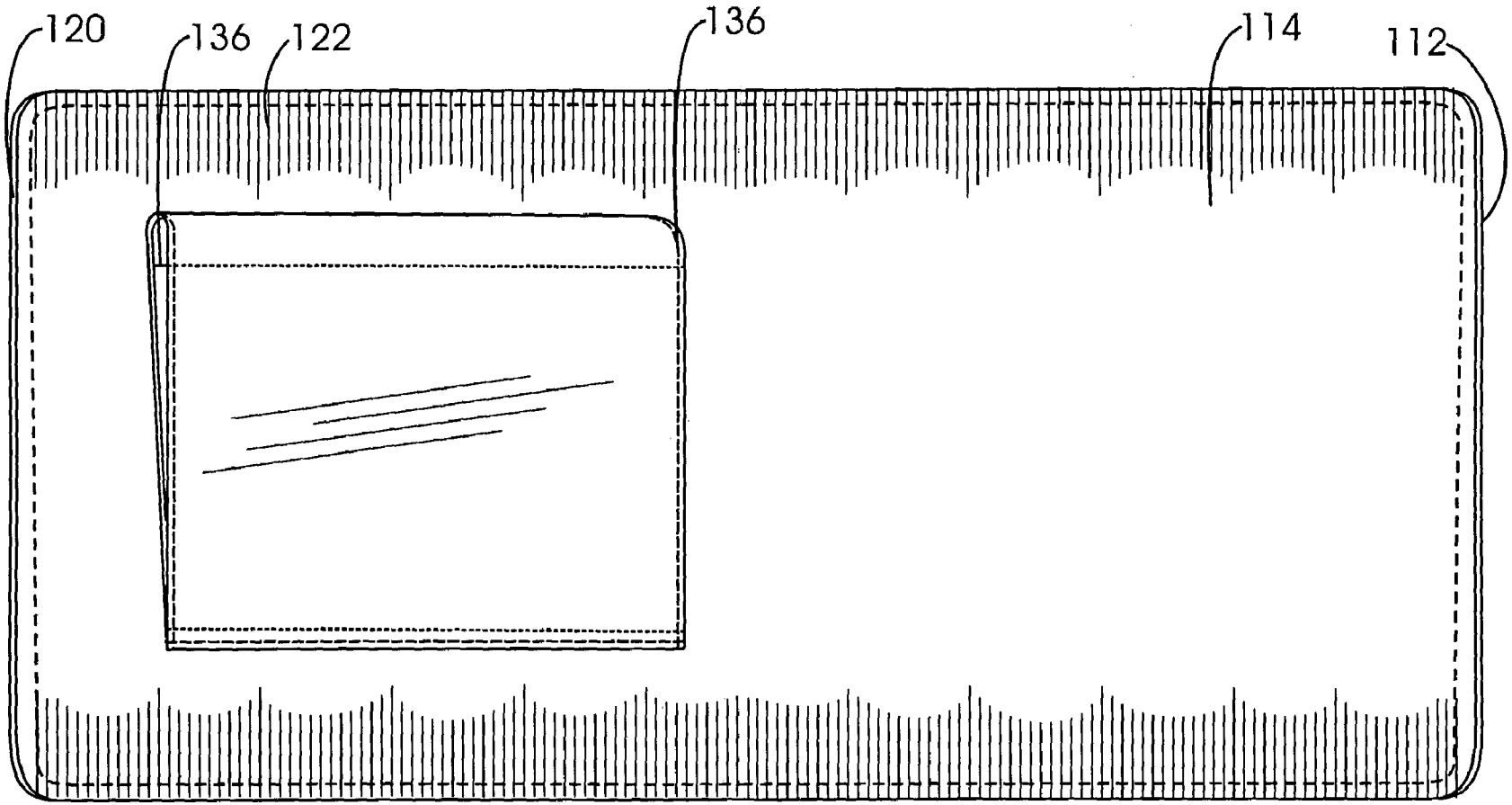
FIG. 16 is a rear elevational view of the present invention man's wallet showing the business card holder permanently attached to an exterior surface by means such a stitching shown in dashed lines.
Figure 17:
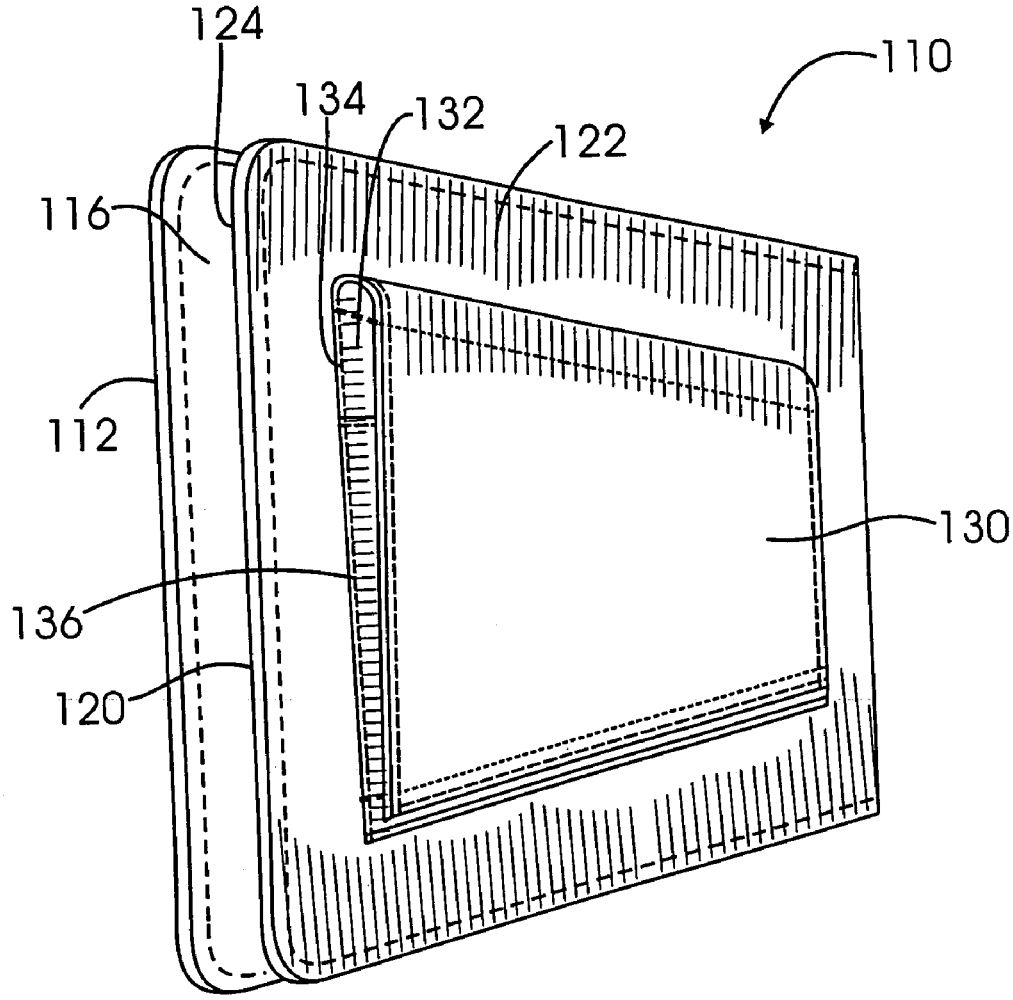
FIG. 17 is a perspective view of the present invention man's wallet with a business card holder permanently attached to an exterior side of the wallet.

The second variation of the present invention is illustrated in FIGS. 15 through 17 where the business card holder is permanently attached to the rear surface of the rear section of the wallet by means such as stitching or adhesive 136. The man's wallet 110 is a conventional billfold having a first section 112 and a second section 120. The first section 112 has an exterior front surface 114 which does not have components thereon and an interior surface 116 which in one example as illustrated in FIG. 9 has a multiplicity of slots for retaining credit cards, a driver's license, etc. The second section 120 has an exterior rear surface 122 and an interior surface 124 which in one example as illustrated in FIG. 9 has a closable compartment for containing change, keys, etc. There also conventional billfold slots 26 in FIG. 9 which extend the interior length of the wallet 110 for retaining paper currency.

The present invention is to incorporate a business card holder 130 onto the rear surface 122 of the wallet 110. In the section variation, the business card holder 130 has a rear section 132 with a rear surface 134 which incorporates permanent attaching means such as stitching 136 onto the exterior rear surface 122 of second section 120.

The business card holder 130 is illustrated in FIG. 15. The rear section 132 has an interior surface 138 which optionally may contain a compartment 140 having an interior 21 section 142 wherein the compartment 140 to retain business cards is between the interior 22 section 142 and the interior surface 138 of rear section 132. The interior section 132 also contains a mating hook and/or loop fastener 144.

The business card holder 130 also has a front section 150 with a front surface 152. Referring to FIG. 15, the front section 150 has an interior surface 154 which optionally may contain a compartment 156 having an interior section 158 wherein the compartment 156 to retain business cards is between the interior section 158 and the interior surface 154 of front section 150. The interior section 158 also contains a mating hook and/or loop fastener 160 which mates with mating hook and loop fastener 144 to close the business card holder 130.

The rear section 132 of the business card holder 130 contains a pair of reinforcements 162 and 164 at its opposite interior corners and the front section 150 also contains a pair of reinforcements 166 and 168 at its opposite interior corners. The reinforcements 162, 164, 166, and 168 serve to keep the business cards contained in the business card holder 130 crisp for ready removal.

Referring to FIGS. 16 and 17, the rear section 132 of business card holder 130 is shown stitched onto the rear surface 122 of rear section 120 of wallet 110. Therefore, when joined in this way, the business card holder 130 is permanently attached on its rear surface 134 of its rear section 132 to the exterior rear surface 122 of second section 120 of wallet 110. As illustrated in FIG. 17, with the business card holder 130 attached to the wallet in this way, the business card holder 130 fits smoothly against the rear surface 122 of the wallet 110 so that the wallet 110 with its contents including paper money, credit cards, driver's license, etc. and the business card holder 130 with business cards contained therein will fit into the pocket of a man's pants or into the inside pocket of the jacket of a suit or sports coat.

Since the business card holder 130 is retained by permanent means 136 such as stitching or adhesive bonding, it is preferred that the business card holder 130 be made of material which is the same material out of which the wallet is made. However, it is also possible for the wallet 110 and the business card holder 130 to be made out of different material. The wallet material is usually leather but can also be made of a synthetic material. Similarly, the business card holder can be made of leather or of a synthetic material.

Defined in detail, the present invention is a man's wallet comprising: (a) a first section of the wallet having an exterior front surface and a second section of the wallet having an exterior rear surface, the exterior rear surface of the second section having removable attachment means thereon; (b) a business card holder having a rear section with an exterior rear surface and a front section with an exterior front surface, the rear surface of the rear section having removable attachment means thereon; and (c) the rear surface of the rear section of the business card holder removably attached to the exterior rear surface of the second section of the wallet through their respective removable attachment means so that the combination of the man's wallet and business card holder is sized to fit into a pocket of a man's pants or an interior pocket of a suit jacket or sports coat.

Defined alternatively in detail, the present invention is a man's wallet comprising: (a) a first section of the wallet having an exterior front surface and a second section of the wallet having an exterior rear surface; (b) a business card holder having a rear section with an exterior rear surface and a front section with an exterior front surface; and (c) the rear section of the business card holder permanently attached to the exterior rear surface of the second section of the wallet so that the combination of the man's wallet and business card holder is sized to fit into a pocket of a man's pants or an interior pocket of a suit jacket or sports coat.

Defined more broadly, the present invention is a man's wallet comprising: (a) at least one section of the wallet with at least one exterior surface; (b) a business card holder having at least one section with at least one exterior surface; and (c) the at least one section of the business card holder attached to the at least one exterior surface of the at least one section of the man's wallet so that the combination of the man's wallet and business card holder is sized to fit into a pocket of a man's pants or an interior pocket of a suit jacket or sports coat.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A man's wallet comprising:

a. a first section of the wallet having a rectangular exterior front surface and a second section of the wallet having a rectangular exterior rear surface, the exterior rear surface of the second section having removable attachment means thereon;

b. a business card holder having a rear section with an exterior rear surface and a front section with an exterior front surface, the rear section having a rectangular shape with a perimeter that is equal to or smaller than the perimeter of the wallet, and the front section having a rectangular shape, the rear surface of the rear section having removable attachment means thereon;

c. the rear surface of the rear section of the business card holder removably attached to the rectangular exterior rear surface of the second section of the wallet through their respective removable attachment means;

d. the size and shape of the combination of the wallet and business card holder formed to be a combined size which enables the combination of the man's wallet and business card holder to fit into a pocket of a man's pants and interior pocket of a suit jacket or sports coat;

e. the first and second sections of said business card holder further comprise internal surfaces with at least one internal surface having means for retaining business cards within the business card holder; and f. said business card holder is generally rectangular and further comprises reinforcement means on opposite corners of the front section and reinforcement means on opposite corners of the rear section so that business cards retained within the business card holder are maintained crisp and easily removable from the business card holder.

2. The invention in accordance with claim 1 wherein said business card holder further comprises internal closing means by which the business card holder is maintained closed.

3. The invention in accordance with claim 1 wherein the removable attachment means on the rear surface of the rear section of the wallet and the removable attachment means on the rear surface of the rear section of the business card holder are mating hoop and loop fasteners.

4. The invention in accordance with claim 1 wherein said first and second sections of said wallet each further comprises internal surfaces which support means to retain paper money, credit cards and a driver's license.

5. The invention in accordance with claim 1 wherein the man's wallet and the business card holder are made of the same material.

6. The invention in accordance with claim 1 wherein the man's wallet and the business card holder are made of different material.

7. A man's wallet comprising:

a. a first section of the wallet having a rectangular exterior front surface and a second section of the wallet having a rectangular exterior rear surface;

b. a business card holder having a rear section with an exterior rear surface and a front section with an exterior front surface;

c. the rear section of the business card holder permanently attached to the rectangular exterior rear surface of the second section of the wallet;

d. the size and shape of the combination of the wallet and business card holder formed to be a combined size which enables the combination of the man's wallet and business card holder to fit into a pocket of a man's pants and interior pocket of a suit jacket or sports coat;

e. the first and second sections of said business card holder further comprise internal surfaces with at least one internal surface having means for retaining business cards within the business card holder; and f. said business card holder is generally rectangular and further comprises reinforcement means on opposite corners of the front section and reinforcement means on opposite corners of the rear section so that business cards retained within the business card holder are maintained crisp and easily removable from the business card holder.

8. The invention in accordance with claim 7 wherein the business card holder a permanently attached to the man's wallet by stitching.

9. The invention in accordance with claim 7 wherein said business card holder further comprises internal closing means by which the business card holder is maintained closed.

10. The invention in accordance with claim 7 wherein said first and second sections of said wallet each further comprises internal surfaces which support means to retain paper money, credit cards and a driver's license.

11. The invention in accordance with claim 7 wherein the man's wallet and the business card holder are made of the same material.

12. A man's wallet comprising:

a. a first section of the wallet having a rectangular exterior front surface and a second section of the wallet having a rectangular exterior rear surface, the exterior rear surface of the second section having removable attachment means thereon;

b. a business card holder having a rear section with an exterior rear surface and a front section with an exterior front surface, the rear section having a rectangular shape with a perimeter that is equal to or smaller than the perimeter of the wallet, and the front section having a rectangular shape, the rear surface of the rear section having removable attachment means thereon;

c. the rear surface of the rear section of the business card holder removably attached to the rectangular exterior rear surface of the second section of the wallet through their respective removable attachment means;

d. the size and shape of the combination of the wallet and business card holder formed to be a combined size which enables the combination of the man's wallet and business card holder to fit into a pocket of a man's pants and interior pocket of a suit jacket or sports coat; and e. the removable attachment means on the rear surface of the rear section of the wallet and the removable attachment means on the rear surface of the rear section of the business card holder are mating hook and loop fasteners.

* * * * *